US007401775B2

(12) United States Patent
Hirth et al.

(10) Patent No.: US 7,401,775 B2
(45) Date of Patent: Jul. 22, 2008

(54) APPARATUS FOR ALIGNING SHEETS WHICH ARE DEPOSITED ON A SHEET STACK

(75) Inventors: Roland Hirth, Römerberg (DE); Rainer Klenk, St. Leon-Rot (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 340 days.

(21) Appl. No.: 11/053,993

(22) Filed: Feb. 9, 2005

(65) Prior Publication Data

US 2005/0184452 A1 Aug. 25, 2005

(30) Foreign Application Priority Data

Feb. 19, 2004 (DE) ..... 10 2004 008 079

(51) Int. Cl.
*B65H 31/12* (2006.01)

(52) U.S. Cl. ..... 271/218; 271/213; 271/220; 271/224

(58) Field of Classification Search ..... 271/3.02, 271/220, 221, 224, 213, 218; 414/213, 218, 414/224

See application file for complete search history.

(56) References Cited

U.S. PATENT DOCUMENTS

| | | | | |
|---|---|---|---|---|
| 3,972,524 | A * | 8/1976 | Despot et al. | 271/218 |
| 4,662,275 | A | 5/1987 | Tertilt | |
| 5,054,765 | A | 10/1991 | Henn et al. | |
| 5,407,189 | A * | 4/1995 | Klenk | 271/218 |
| 5,697,605 | A | 12/1997 | Pollich et al. | |
| 2003/0184011 | A1 * | 10/2003 | Schaareman et al. | 271/207 |
| 2004/0207148 | A1 * | 10/2004 | Murata et al. | 271/207 |

FOREIGN PATENT DOCUMENTS

| | | |
|---|---|---|
| DE | 419366 | 10/1925 |
| DE | 1 461 219 | 6/1969 |
| DE | 34 23 265 A1 | 4/1985 |
| DE | 195 07 370 C2 | 9/1996 |
| EP | 0 974 543 B1 | 1/2000 |

* cited by examiner

*Primary Examiner*—Patrick H. Mackey
*Assistant Examiner*—Gerald W McClain
(74) *Attorney, Agent, or Firm*—Laurence A. Greenberg; Werner H. Stemer; Ralph E. Locher

(57) ABSTRACT

In an apparatus for aligning sheets that are deposited on a sheet stack, there are sheet leading edge stops disposed so as to be vertically displaceable by a common leading edge shaft. An auxiliary stack carrier that is to be introduced into the stack region for nonstop operation causes the leading edge shaft or leading edge stops to be raised.

10 Claims, 5 Drawing Sheets

APPARATUS FOR ALIGNING SHEETS WHICH ARE DEPOSITED ON A SHEET STACK

BACKGROUND OF THE INVENTION

Field of the Invention

It is known to provide leading edge stops for sheets that are to be deposited onto a stack in a deliverer of sheet processing machines. The sheets that are conveyed to the stack come into contact with the leading edge stops and thereupon come to lie exactly on the sheet stack.

As is known, the leading edge stops are disposed on a common crossmember—what is known as a leading edge stop shaft—and mounted so as to be pivotable, for example, about a rotational axis which is arranged below the leading edge stops.

Published, non-prosecuted German patent application DE 34 23 265 A1 (corresponding to U.S. Pat. No. 4,662,275) shows, for example, leading edge stops with a leading edge stop shaft lying underneath. Here, it is disadvantageous that bridging boards or rakes can be inserted only below the leading edge shaft, for example for nonstop operation, as the access to the upper stack region is impeded by the leading edge stops and the leading edge shaft.

It is known, for example, from German patent DE 195 07 370 C2 (corresponding to U.S. Pat. No. 5,697,605) to dispose the leading edge stops so as to be vertically displaceable.

SUMMARY OF THE INVENTION

It is accordingly an object of the invention to provide an apparatus for aligning sheets which are deposited on a sheet stack which overcomes the above-mentioned disadvantages of the prior art devices and methods of this general type, which offers the possibility of introducing auxiliary stack devices into the stack in the upper stack region, in particular for nonstop operation.

With the foregoing and other objects in view there is provided, in accordance with the invention, an apparatus for aligning sheets. The apparatus includes a common vertically displaceable leading edge shaft having support devices, leading edge stops disposed on the leading edge shaft, and an auxiliary stack carrier having a lifting device. The supporting devices of the leading edge shaft are disposed for being brought into operating contact with the lifting device for vertically displacing the leading edge shaft.

It is an advantage of the invention that the leading edge stops and the leading edge shaft are disposed such that they can be displaced upward vertically, as a result of which it is possible to free the upper stack region for the introduction of rakes or bridging boards for a nonstop stack change, while the function of the leading edge stops is maintained. In order to initiate the vertical displacement of the leading edge shaft, there is provision according to the invention for at least one supporting element, for example a rotatably mounted roller, to be provided on the leading edge shaft, which roller comes into contact with a component of the rake or of the bridging board in such a way that the leading edge shaft is raised in linear guides. In a first exemplary embodiment, the component is a run-up slope that is disposed on rake frames or bridging board frames.

In a second exemplary embodiment, there is provision for the leading edge shaft to be raised by a sensor-controlled actuator, preferably by a pneumatically acting operating cylinder.

Other actuators are of course conceivable, such as hydraulically actuable operating cylinders, actuating motors, etc.

In an advantageous refinement, a switch that can be actuated by the movement of the leading edge shaft is provided which brings the main stack lifting device to a standstill in the event of an undesirably great deflection of the leading edge shaft.

Other features which are considered as characteristic for the invention are set forth in the appended claims.

Although the invention is illustrated and described herein as embodied in an apparatus for aligning sheets which are deposited on a sheet stack, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
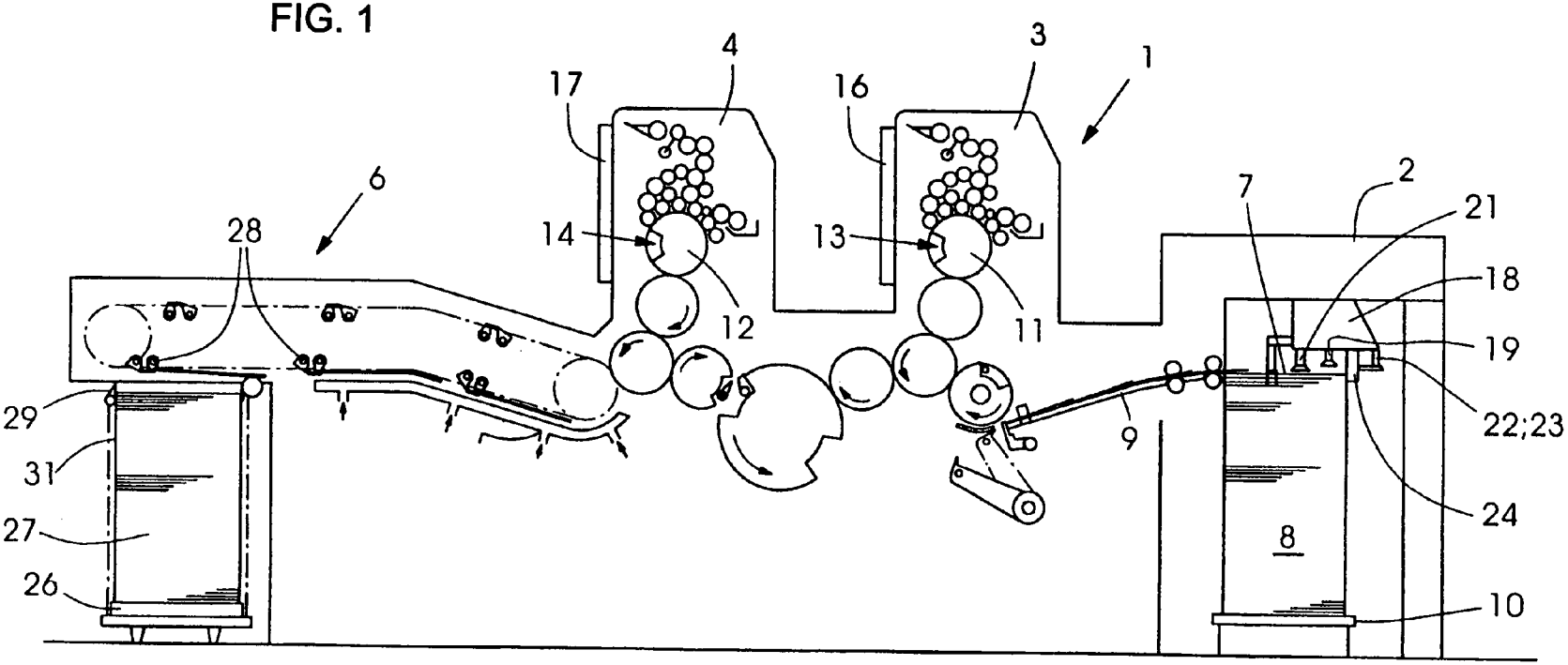
FIG. 1 is a diagrammatic, side-elevational view of a sheet processing printing press.

Referring now to the figures of the drawing in detail and first, particularly, to FIG. 1 thereof, there is shown a machine which processes sheets 7, for example a printing press 1, having a feeder 2, at least one printing unit 3 and/or 4 and a deliverer 6. The sheets 7 are removed from a sheet stack 8 and fed to the printing units 3 and 4 via a feed table 9 individually or overlapped. The printing units 3 and 4 each contain a plate cylinder 11; 12 in a known manner. The plate cylinders 11 and 12 each have an apparatus 13, 14 for fastening flexible printing plates. Moreover, each plate cylinder 11; 12 is assigned an apparatus 16; 17 for the semiautomatic or fully automatic changing of printing plates.

The sheet stack 8 lies on a stack board 10 which can be raised in a controlled manner. The sheets 7 are removed from the upper side of the sheet stack 8 by what is referred to as a suction head 18 which, inter alia, has a number of lifting and dragging suckers 19, 21 for separating the sheets 7.

Moreover, blowing devices 22 are provided for loosening the upper sheet layers, and sensing elements 23 are provided for tracking the stack. In order to align the sheet stack 8, in particular the upper sheets 7 of the sheet stack 8, a number of lateral and rear stops 24 are provided.

The deliverer 6 has, inter alia, a main stack board 26 for accommodating a sheet stack 27. The sheets 7 are fed to the sheet stack 27 by a chain gripper system 28. Leading edge stops 29 are disposed on a stack leading edge 31 in the upper stack region and assist exact stack formation.

Figure 2:
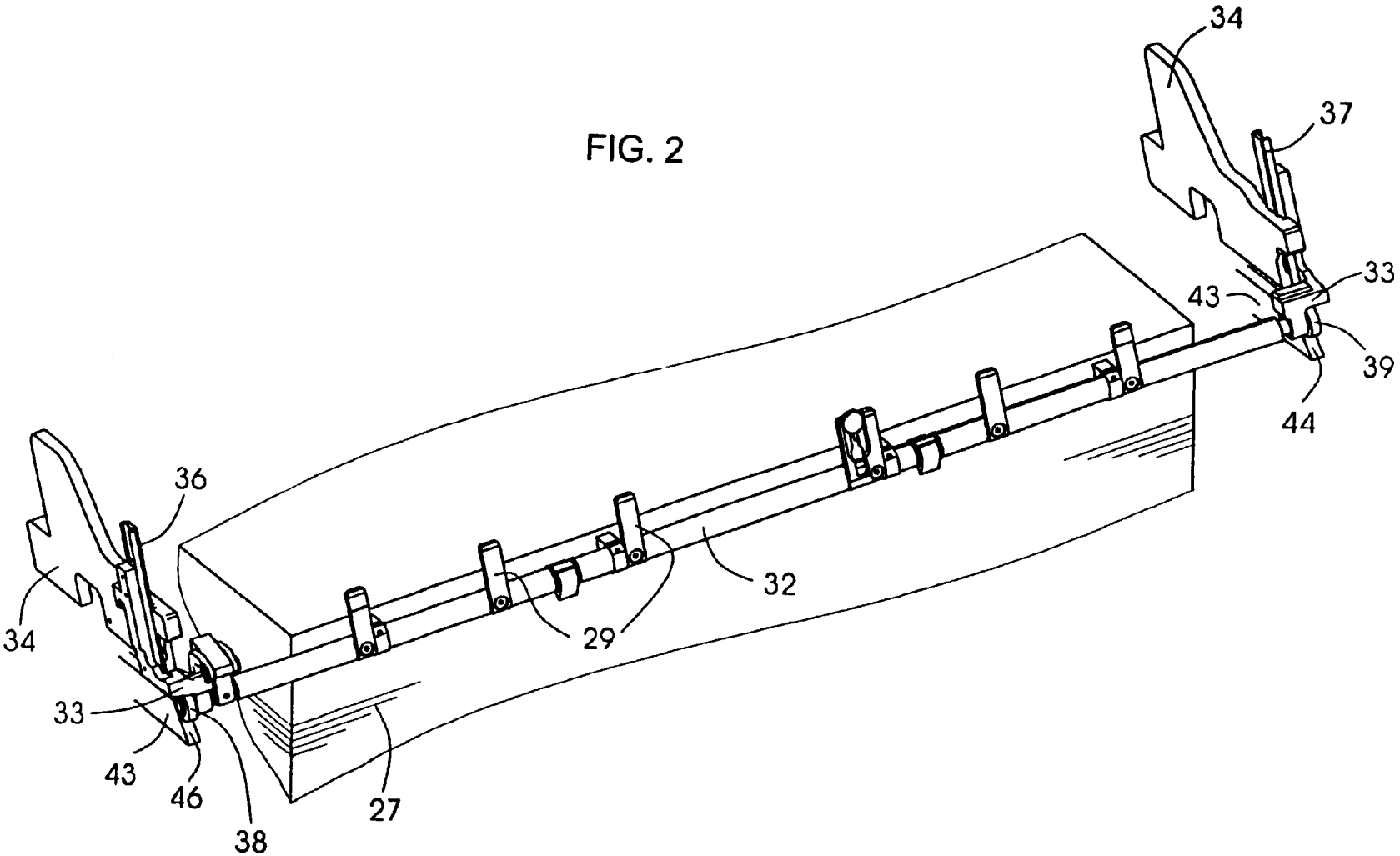
FIG. 2 is a perspective view, from behind counter to a sheet transport direction, of an apparatus according to the invention.
Figure 3:
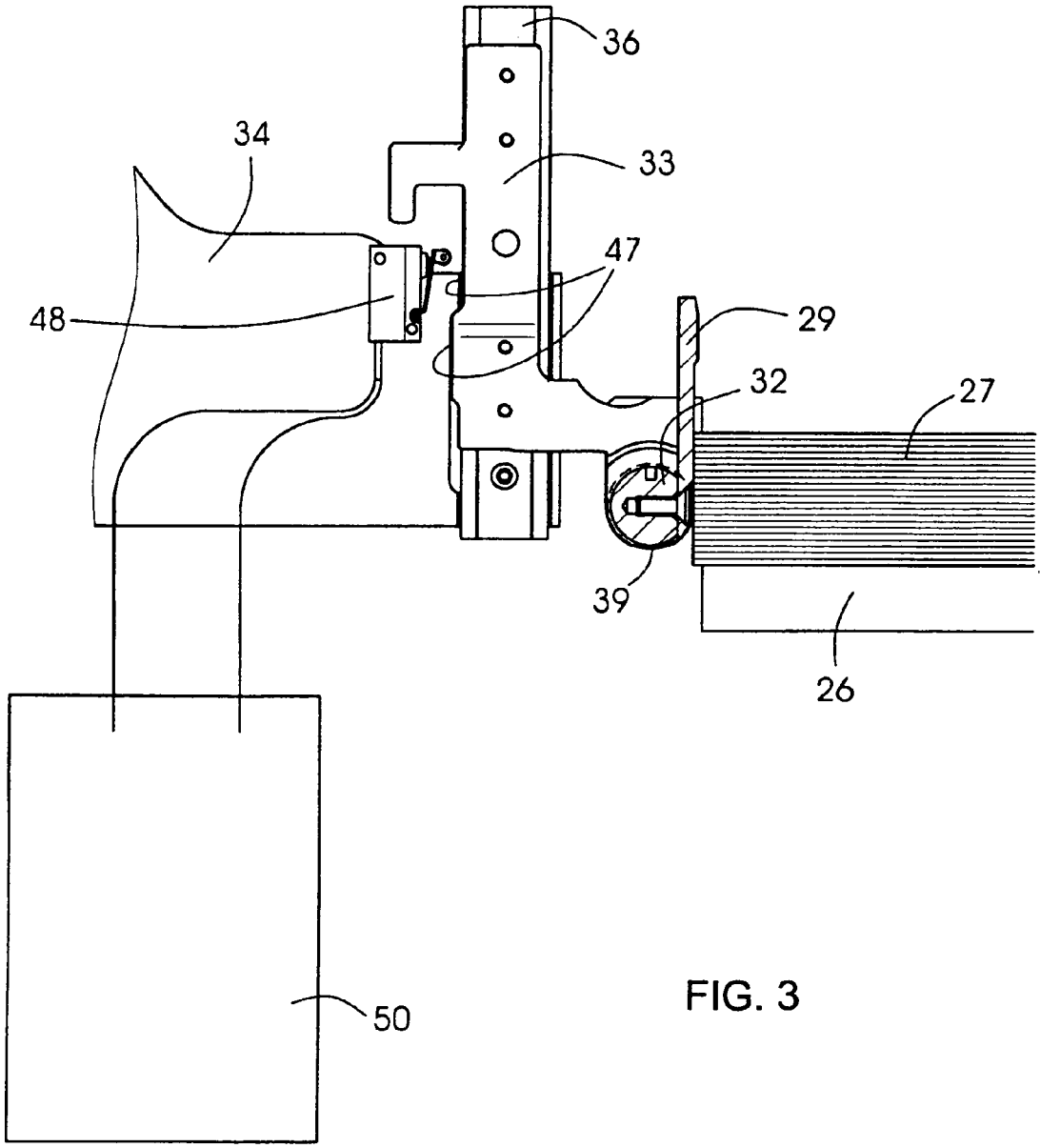
FIG. 3 is a diagrammatic, side-elevational view of the apparatus according to the invention.

As shown in FIGS. 2 and 3, the leading edge stops 29 are disposed on a common leading edge shaft 32 at a distance from one another. The leading edge shaft 32 is mounted pivotably in a holder 33 and disposed so as to be vertically displaceable by the holder 33. The vertical displaceability is made possible by linear guides 36, 37 that are disposed on both sides of a deliverer frame 34. At its ends, the leading edge shaft 32 bears in each case one supporting element which is configured as a rotatably mounted roller 38; 39.

Figure 4:
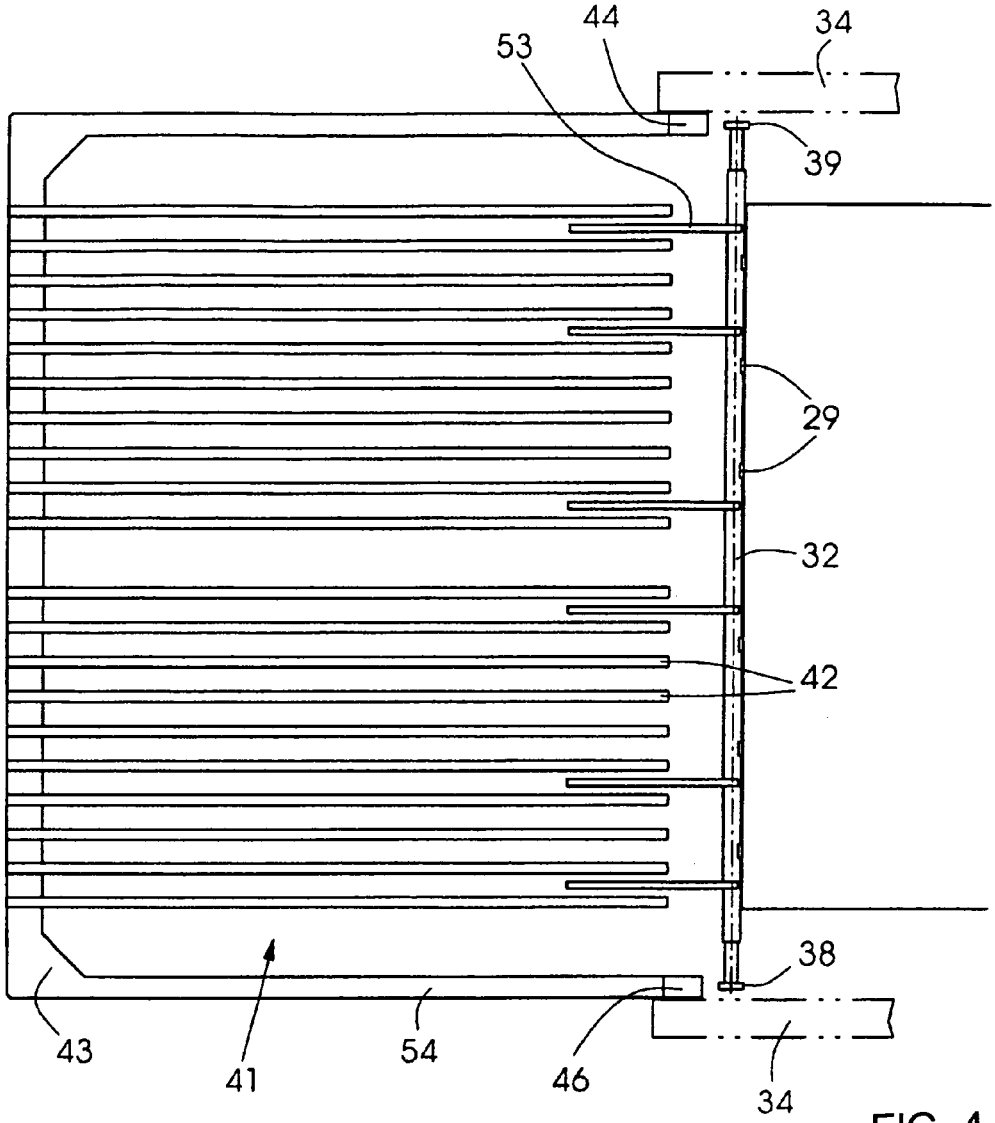
FIG. 4 is a plan view of a nonstop rake with a rake frame or rake carriage.

FIG. 4 shows an auxiliary stack carrier 41 in the form of a rake or bridging board, which is provided for nonstop stack changing, and has, for example, a number of rake bars 42 which are fastened to a U-shaped frame 43. The frame 43, together with the rake bars 42, is mounted so as to be horizontally displaceable (counter to the sheet transport direction) into the stack region for auxiliary stack holding. The U-shaped frame 43 surrounds the rake bars 42 and, at its ends which point in the direction of the stack 27, has in each case a run-up slope 44, 46 which come into operating contact with the rollers 38, 39 when the rake bars 42 are introduced into the stack region. As a result, the roller 38; 39 is raised and accordingly takes the leading edge shaft 32 with the leading edge stops 29 fastened thereto and also the holders 33 with it. On one side of the deliverer frame 34, one of the holders 33 has a control contour 47 (see FIG. 3) which comes into working contact with a switch 48 which is disposed on the deliverer frame 34, if the leading edge shaft 32 should be raised beyond a predefined amount, for example by the raising of the leading edge shaft 32 by the main stack 27. The main stack drive is brought to a standstill by the switch actuation which then occurs.

Figure 5:
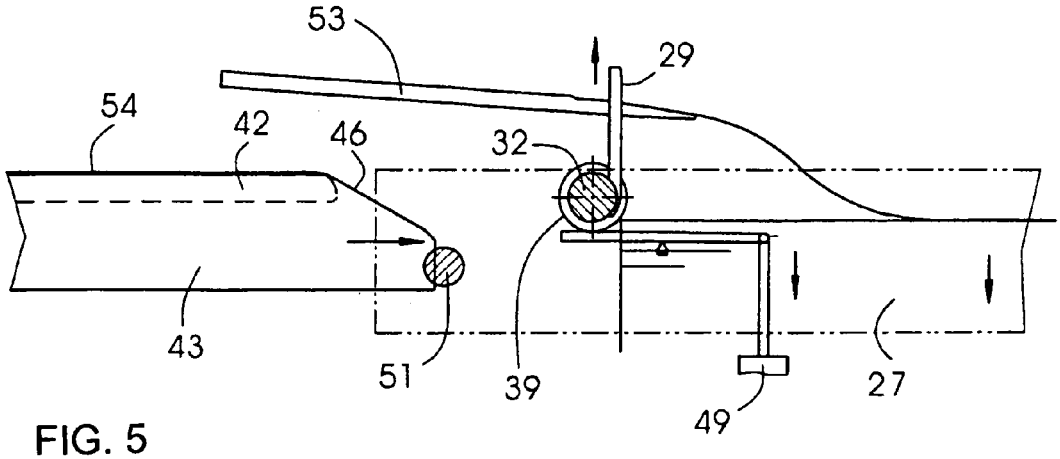
FIG. 5 is a diagrammatic, side-elevational view of a second exemplary embodiment having a pneumaticically actuable operating cylinder.

In a second exemplary embodiment according to FIG. 5, there is provision for the leading edge shaft 32 to be raised by an actuator 49 which can be actuated remotely, as soon as the rake 42, 43 passes into a detection region of a sensor 51 or the switching region of a switch near the leading edge shaft 32. In this case, a signal is generated via a machine controller 50 that is connected to the sensor 51 or switch, which signal results in the activation of the actuator 49. In the exemplary embodiment, the actuator 49 is shown as a pneumatically acting operating cylinder. However, it goes without saying that hydraulically or magnetically or electrically actuable actuating apparatuses can also be used.

Figure 6A:
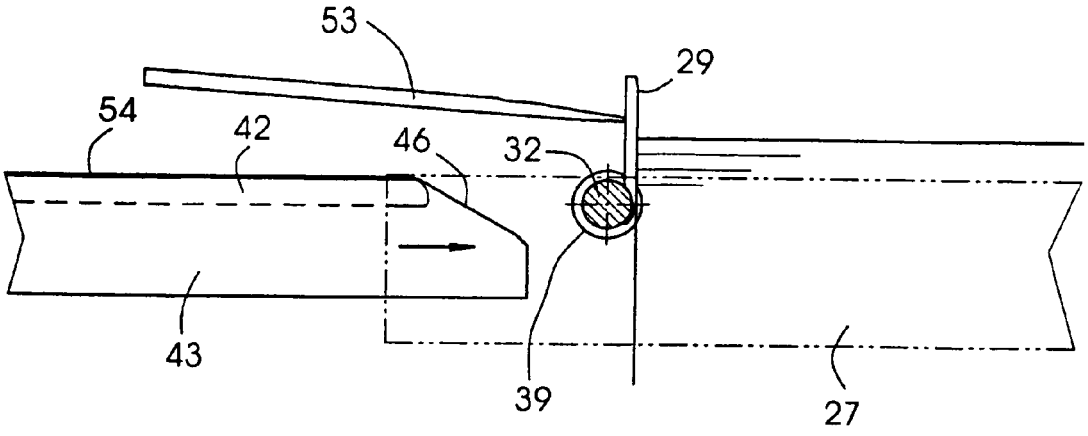
FIG. 6A is a diagrammatic, side-elevational view of a first exemplary embodiment with a position of the leading edge shaft in the basic position.
Figure 6B:
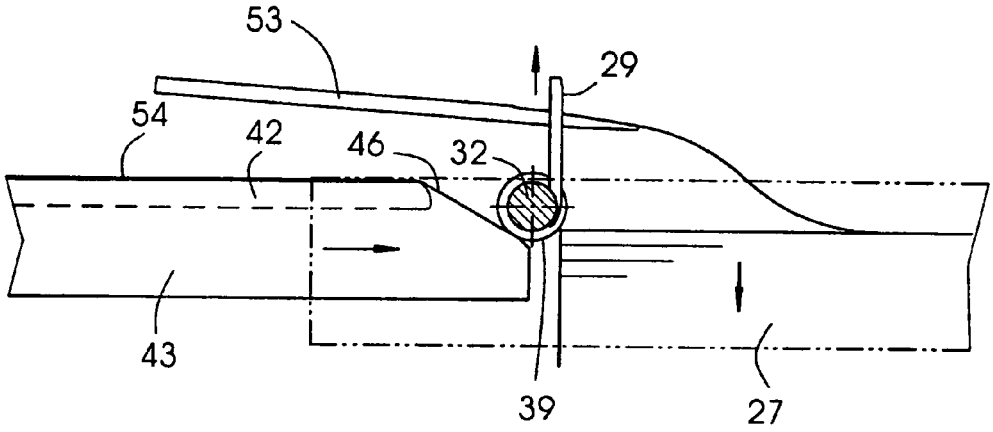
FIG. 6B is a diagrammatic, side-elevational view of the first exemplary embodiment with a position of the leading edge shaft in a slightly raised state.

FIG. 6A shows the nonstop rake 42, 43 with the run-up slope 46 in a position in front of the main stack 27. The sheet processing machine, preferably a printing machine, is in the continuous printing mode, the sheets that are transported by the chain gripper system 28 being deposited onto the sheet stack 27 after they have come into contact with the leading edge stops 29. Here, a sheet interceptor 53 is likewise situated outside the stack region.

Figure 6C:
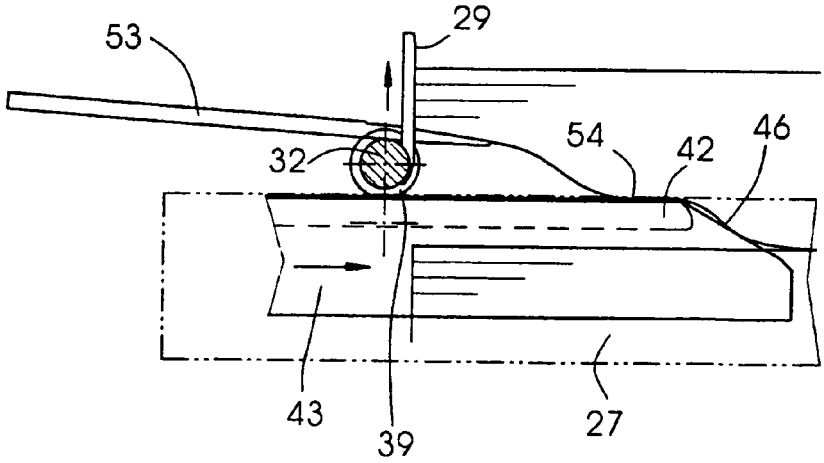
FIG. 6C is a diagrammatic, side-elevational view of the first exemplary embodiment with a position of the leading edge shaft in a fully raised position.

In order to introduce the auxiliary stack device (rakes 42, 43), the sheet interceptor 53 is initially introduced into the stack region. The rake 42, 43 is introduced almost simultaneously into or over the main stack 27 by a horizontal displacement movement. Here, the run-up slopes 44, 46 come into contact with the rollers 38, 39 and lift the leading edge shaft 32. Here, the rollers 38, 39 roll on the upper side of the frame 43 that is configured as a control contour 54 (FIG. 6C).

This application claims the priority, under 35 U.S.C. § 119, of German patent application No. 10 2004 008 079.8, filed Feb. 19, 2004; the entire disclosure of the prior application is herewith incorporated by reference.

We claim:

1. An apparatus for aligning sheets, comprising:

a common vertically displaceable leading edge shaft having support devices;

leading edge stops disposed on said leading edge shaft; and an auxiliary stack carrier having a lifting device, said supporting devices of said leading edge shaft disposed for being brought into operating contact with said lifting device for vertically displacing said leading edge shaft.

2. The apparatus according to claim 1, wherein said supporting devices are rotatably mounted rollers.

3. The apparatus according to claim 1, wherein:

said auxiliary stack carrier has a frame; and said lifting device includes run-up slopes attached to said frame of said auxiliary stack carrier.

4. The apparatus according to claim 1, further comprising at least one actuator acting on said leading edge shaft directly or indirectly for assisting in vertically displacing said leading edge shaft.

5. The apparatus according to claim 4, wherein said actuator can be actuated pneumatically, hydraulically, magnetically or electrically.

6. The apparatus according to claim 5, further comprising:

a machine controller for activating said actuator; and a actuation device, selected from the group consisting of a sensor and a switch, actuated by said auxiliary stack carrier and communicating with said machine controller.

7. The apparatus according to claim 1, further comprising:

a safety switch; and a holder having a control contour for actuating said safety switch, said leading edge shaft mounted on said holder.

8. The apparatus according to claim 7, further comprising linear guides interacting with and guiding said holder, said holder disposed vertically displaceable by said linear guides.

9. The apparatus according to claim 1, wherein the apparatus is configured for being disposed in a deliverer of a rotary press.

10. An apparatus for aligning sheets, comprising:

a common vertically displaceable leading edge shaft having support devices;

leading edge stops disposed on said leading edge shaft; and an auxiliary stack carrier having a lifting device, said supporting devices of said leading edge shaft disposed for being brought into operating contact with said lifting device for vertically displacing said leading edge shaft and said leading edge stops.

* * * * *